US006972645B2

(12) United States Patent
Hidaka et al.

(10) Patent No.: US 6,972,645 B2
(45) Date of Patent: Dec. 6, 2005

(54) RESONATOR, FILTER, COMMUNICATION APPARATUS

(75) Inventors: Seiji Hidaka, Nagaokakyo (JP); Shin Abe, Muko (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/814,645

(22) Filed: Apr. 1, 2004

(65) Prior Publication Data

US 2004/0257175 A1 Dec. 23, 2004

(30) Foreign Application Priority Data

Jun. 18, 2003 (JP) ..... 2003-173746

(51) Int. Cl.[7] ..... H01P 1/203; H01P 7/08
(52) U.S. Cl. ..... 333/202; 333/204; 333/219
(58) Field of Search ..... 333/202, 134, 333/204, 219, 219.1

(56) References Cited

U.S. PATENT DOCUMENTS 6,144,268 A * 11/2000 Matsui et al. ..... 333/134
6,201,456 B1 * 3/2001 Hiratsuka et al. ..... 333/134
2003/0234704 A1 * 12/2003 Hidaka et al. ..... 333/126

FOREIGN PATENT DOCUMENTS

| | | |
|---|---|---|
| JP | 62-193302 | 8/1987 |
| JP | 62-298202 | 12/1987 |
| JP | 02-096402 | 4/1990 |

OTHER PUBLICATIONS

"Analysis, Design and Applications of Fin Lines;" Bharathi Bhat, et al.; Artech House, Inc.' USA; 1987; pp. 316-317.
"Basics and Applications of Microwave Circuit (Maikuroha no Kiso to Ouyou);" Yoshihiro Konishi; Sougou Denshi Syuppansya; 1990; p. 169.

* cited by examiner

*Primary Examiner*—Seungsook Ham
(74) *Attorney, Agent, or Firm*—Dickstein, Shapiro, Morin & Oshinsky, LLP.

(57) ABSTRACT

A conductive film is provided on a dielectric substrate. The conductive film has conductor opening portions, which serve as inductive regions, and a conductor opening portion, which serves as a capacitive region. Multi-step ring resonator elements, each including a conductor line aggregate, are provided on respective substrates to configure resonator elements. The resonator elements are mounted above the conductor opening portions that serve as the inductive regions. This arrangement provides a resonator having a high Qo.

11 Claims, 17 Drawing Sheets

SECTION A-A

SECTION A-A

IAa
CAa
IAb
CAb
IAc

100
CAa
100
CAb
100
14
7
12
8a
8b
SECTION A-A (B)
14
CAb
12
7
7
8b
9b
SECTION B-B

14
A
A

14
B
B
C
C
7
9b
9a

RESONATOR, FILTER, COMMUNICATION APPARATUS

BACKGROUND OF THE INVENTION

1. Field of the Invention

The present invention relates to a resonator, a filter, and a communication apparatus for use in, for example, radio communication in a microwave band or millimeter-wave band or transmission/reception of electromagnetic waves.

2. Description of the Related Art

In resonators using slot lines, design approaches that employ a step-impedance structure for the slot lines have been known for miniaturization of the resonators. Examples are described in Bharathi Bhat and Shiban K. Koul, "Analysis, Design and Applications of Fin Lines", pp. 316–317, Artech House, Inc., U.S.A. 1987 and Yoshihiro Konishi, "Basics and Applications of Microwave Circuit (Maikuroha no Kiso to Ouyou)", Sougou Denshi Syuppansya, pp. 169, 1990 (first edition). In the examples, the width in the vicinities of the opposite ends of the slot line is increased and the width of the center portion of the slot line is reduced, so that the impedance of the vicinities of the opposite ends of the slot line becomes inductive and the impedance of the center portion of the slot line becomes capacitive. Thus, the impedance in a direction along the slot line varies in a stepped manner, so that the length of the slot line needed for providing the same resonant frequency can be reduced.

FIGS. 16A and 16B show a typical example of such a known slot resonator having stepped impedance. FIG. 16B is a top view of a substrate having a slot resonator. FIG. 16A is a sectional view of the section A—A shown in FIG. 16B. A conductive film 10, which has conductor opening portions APa, APb, and APc, is provided on a surface of a dielectric substrate 1. The conductor opening portions APa, APb, and APc together define one dumbbell-shaped conductor opening portion. The widths of the conductor opening portions APa and APb (the widths can be called diameters in this case, because of their circular shapes) located at the opposite ends are relatively large, whereas the width of the center conductor opening portion APc is relatively small. As a result, the opposite ends of the dumbbell-shaped conductor opening portion have inductive impedance and the center portion has capacitive impedance.

The dotted lines in FIG. 16A schematically indicate the magnetic force lines of the slot resonator. The magnetic force lines represent the magnetic field distribution of the slot resonator. Thus, in the slot resonator having a stepped impedance structure, when a magnetic field vector is directed upward in one of the inductive regions located at the opposite ends, a magnetic field vector in the other inductive region is directed downward. As a result, the entire conductor opening portion behaves like a magnetic dipole. Much of magnetic field energy generated by the resonance is concentrated in inductive regions defined by the conductor opening portions APa and APb, and much of electric field energy is distributed along a capacitive region defined by the conductor opening portion APc. In this manner, the storing region of the magnetic field energy and the storing region of the electric field energy are separated from each other. Consequently, the conductor opening portion functions as a lumped element circuit, thereby making it possible to reduce the size of the slot resonator.

The slot resonator described above can be miniaturized due to its stepped impedance when it is configured to have the same resonant frequency. However, as the size of the resonator is reduced, the density of current flowing through the conductive film increases and thus the conductor loss increases. This poses a problem in that a resonator having a high unloaded Q-factor (Qo) cannot be provided.

SUMMARY OF THE INVENTION

Accordingly, an object of the present invention is to provide a resonator that is miniaturized through stepped impedance and that has a high Qo and to provide a filter and a communication apparatus including the resonator.

One aspect of the present invention provides a resonator that includes a substrate and a conductive film. The conductor film has conductor opening portions at predetermined positions. The conductor opening portions include at least two inductive regions, which are defined by relatively large openings, and at least one capacitive region, which is defined by a relatively small opening. The at least one capacitive region interconnects the inductive regions.

Preferably, the at least one resonator element is provided in the inductive regions or in the vicinities of the inductive regions. Each resonator element includes at least one ring-like resonance unit. Each resonance unit is defined by at least one conductor line and has at least one capacitive area and at least one inductive area. A first end of one conductor line is placed adjacent to a second end of the conductor line or a first end of another conductor line included in the same resonance unit in a width direction or a thickness direction to define the at least one capacitive area.

With this structure, the capacitive areas of the resonator element serves as a capacitor and each conductor line serves as a half-wavelength line with the opposite ends being open. Thus, the edge effect that occurs at the edge portion of the conductor and the skin effect that occurs at the conductor surface are eased, thereby reducing the conductor loss. As a result, a miniaturized resonator having a high Qo can be provided.

Another aspect of the present invention provides a resonator that includes dielectric layers and conductor layers. The dielectric layers and the conductive layers are stacked to have at least two conductor opening portions where any of the conductor layers is not provided in the stacking direction of the dielectric layers and the conductor layers and to have at least one portion where the conductor layers face each other in the stacking direction with the corresponding dielectric layers interposed therebetween. Each conductor opening portion serves as an inductive region, and the at least one portion where the conductor layers face each other serves as a capacitive region and interconnects the inductive regions.

As described above, the capacitive region is defined by a portion where the conductor layers face each other with the corresponding dielectric layers interposed therebetween. Thus, a predetermined amount of capacitance can be generated within a limited area, so that the ratio of stepped impedance can be increased. Accordingly, the resonator can be miniaturized. This arrangement can reduce variations due to the pattern forming accuracy of the conductive films, compared to a case in which a capacitive region is provided in a small opening portion in a conductive film in the same layer. Further, this arrangement can enhance the accuracy of a resonant frequency.

A plurality of sets, each set including the inductive regions and the at least one capacitive region which are interconnected, may be provided. With this arrangement, a large number of resonators can be provided on a single substrate in a highly integrated manner.

Another aspect of the present invention provides a filter. The filter includes the above-described resonator and signal input/output portions that are coupled with the resonator. With this arrangement, a miniaturized filter having a low insertion-loss filter characteristic can be provided.

Yet another aspect of the present invention provides a communication apparatus. The communication apparatus includes the resonator or filter described above. With this arrangement, a high-frequency circuit in which the resonator or the filter is provided is miniaturized, so that a miniaturized communication apparatus can be provided.

DESCRIPTION OF THE PREFERRED EMBODIMENTS

A resonator according to a first embodiment of the present invention will now be described with reference to FIGS. 1A–1B, 2A–2C, 3A–3B and 4A–4B.

Figure 1B:
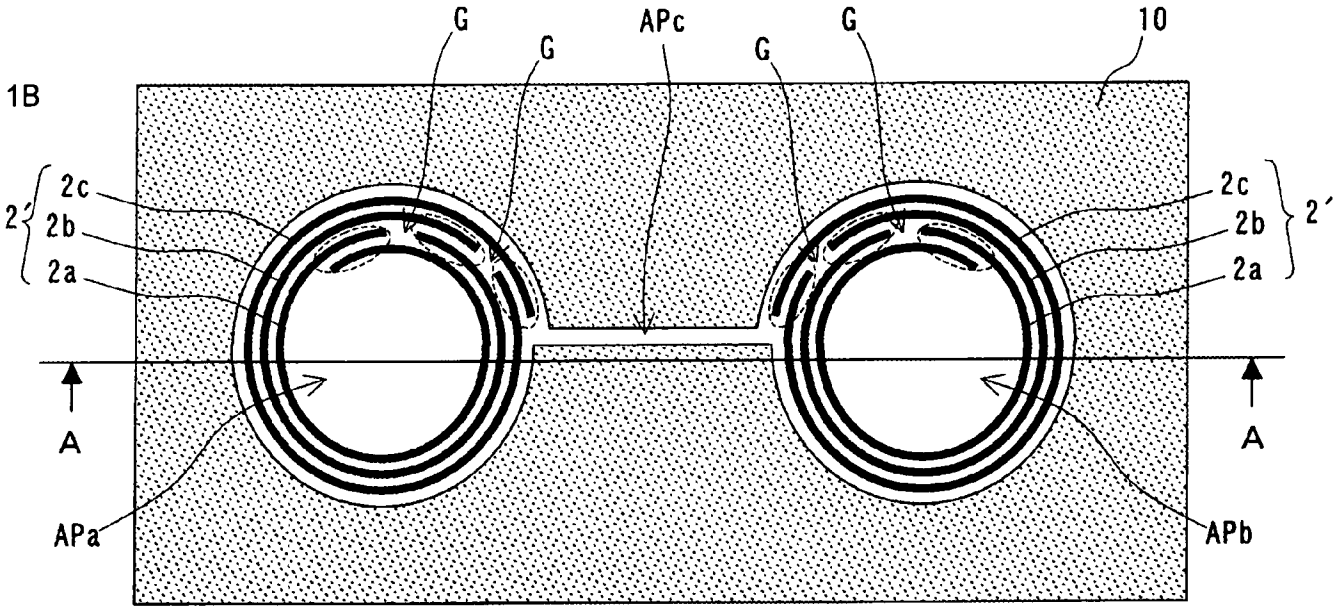
FIGS. 1A and 1B show the configuration of a resonator according to a first embodiment of the present invention.
Figure 1A:
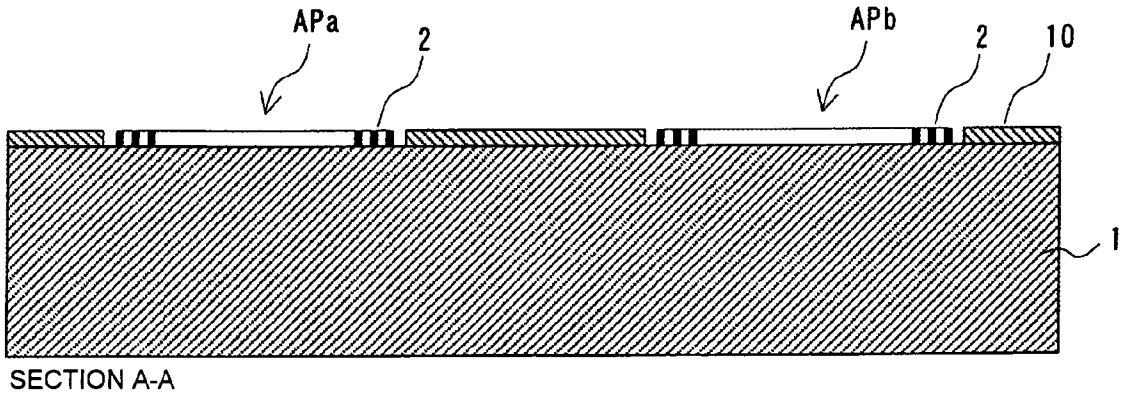

FIG. 1B is a top view of a resonator and FIG. 1A is a sectional view of the section A—A shown in FIG. 1B.

A conductive film 10 is provided on the top surface of a rectangular-plate dielectric substrate 1. The conductive film 10 has a dumbbell-shaped conductor opening portion, which is defined by conductor opening portions APa, APb, and APc. Each of the two conductor opening portions APa and APb, which have large openings, includes a conductor-line aggregate 2' constituted by conductor lines 2*a*, 2*b*, and 2*c*.

In this example, as indicated by the dotted-line ovals in FIG. 1B, the opposite ends of each of the conductor lines 2*a*, 2*b*, and 2*c* are placed adjacent to each other in the width direction. The portions indicated by the dotted-line ovals correspond to capacitive areas of step-ring resonator elements described below. In this example, at positions indicated by G, a first edge of the conductor line 2*a* and a first edge of the conductor line 2*b* are arranged so as to oppose each other with a predetermined distance therebetween and a second edge of the conductor 2*b* and a first edge of the conductor line 2*c* are arranged so as to oppose each other with a predetermined distance therebetween. The pattern of the conductor lines is equivalent to lines obtained by partially cutting one spiral conductor line at predetermined spots (portions indicated by G in FIG. 1B) along the spiral conductor line. That is, when two adjacent resonance units are compared with each other, the capacitive areas (the portions surrounded by the above-noted ovals) of the resonance units are arranged at positions slightly displaced from each other in the circumference direction. Thus, when the positions of the capacitive areas are viewed with respect to a change in the radial direction, the capacitive areas are arranged at positions progressively displaced in the circumference direction in conjunction with a change in the radial direction.

Now, before the description of the operation of the resonator including the conductor lines 2*a*, 2*b*, and 2*c*, one resonance unit will be described with reference to FIGS. 2A to 2C.

Figure 2A:
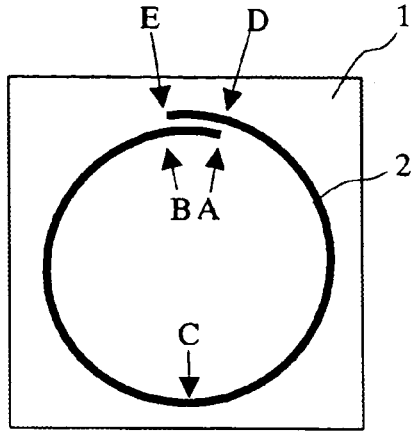
FIGS. 2A, 2B, and 2C show a step-ring resonator element of the resonator, electric field distribution thereof, and current intensity distribution thereof, respectively.

FIG. 2A is a plan view of one resonance unit. FIG. 2B shows electric field distribution at a portion where the opposite ends of a conductor line 2 are adjacent to each other. FIG. 2C shows electrical current distribution along the conductor line 2.

As shown, the conductor line 2 is shaped to go around more than one turn at a preferably constant width on the dielectric substrate 1, and the opposite ends of the conductor line 2 are placed adjacent to each other in the width direction of the conductor line 2. That is, as best shown in FIG. 2B, one end x1 of the conductor line 2 and the other end x2 thereof are adjacent to each other in the width direction.

Figure 2B:
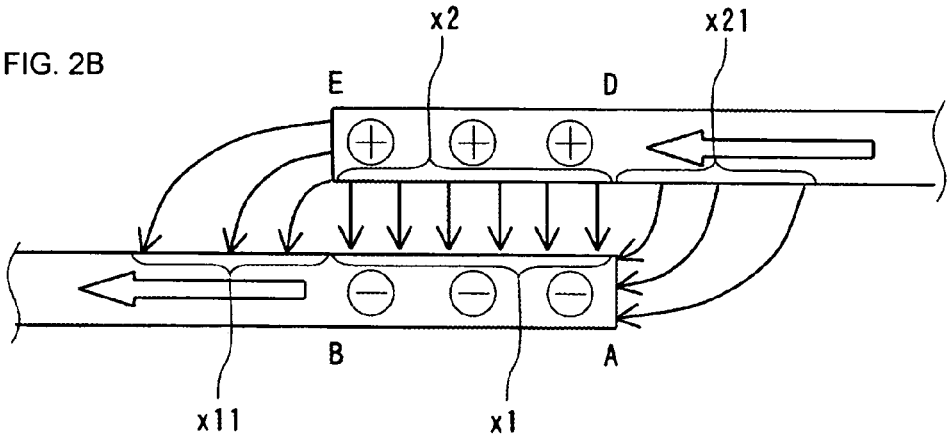

In FIG. 2B, the solid arrows represent electric field vectors and the hollow arrows represent electrical current vectors. As shown in FIG. 2B, an electric field is concentrated at a portion where the both ends x1 and x2 of the conductor line 2 are adjacent to each other in the width direction. Between one edge (indicated by E) of the conductor line 2 and a near-end portion x11 adjacent to the edge E and also between the other edge (indicated by A) of the conductor line 2 and a near-end portion x21 adjacent to the edge A, electric fields are distributed and capacitances are generated.

Figure 2C:
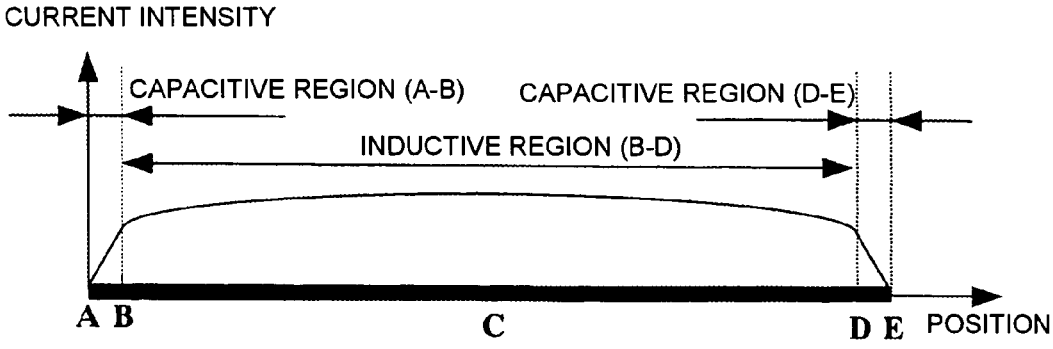

With regard to the electrical current distribution, as shown in FIG. 2C, the current intensity increases rapidly from point A to point B of the conductor line 2, stays at a substantially constant value from point B to point D, and decreases rapidly from point D to E. The current intensities at the opposite ends are 0's. The section A to B and the section D to E, where the opposite ends of the conductor line 2 are adjacent to each other in the width direction, can be referred to as a "capacitive area" and the other section B to D can be referred to as an "inductive area". The capacitive area and the inductive area together cause resonance. Thus, when regarded as a lumped element circuit, the resonance unit serves as an LC resonator circuit.

Hereinafter, a ring-like unit that is defined by a conductor line and that has a capacitive area and an inductive area as described above will simply be referred to as a "resonance unit".

Thus, the resonance unit has an inductive area where the impedance is high and a capacitive area where the impedance is low, and the impedance of the resonance unit varies in a stepped manner. The resonance unit, therefore, will be referred to as a "step ring". Further, a resonator element including a plurality of resonance units will be referred to as a "multi-step ring resonator element".

As described above, an aggregate of many conductor lines 2 is arranged within a limited area to configure a miniaturized resonator having many conductor lines.

Figure 3A:
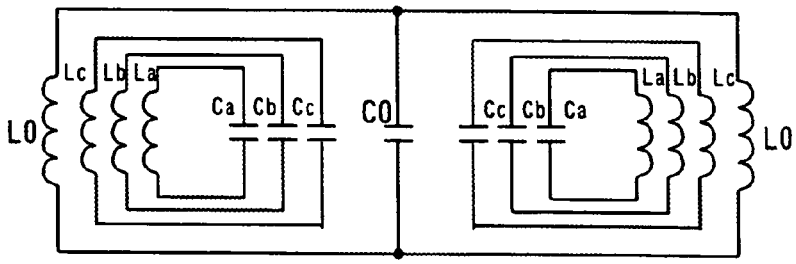
FIGS. 3A and 3B are equivalent circuit diagrams of the resonator.
Figure 3B:
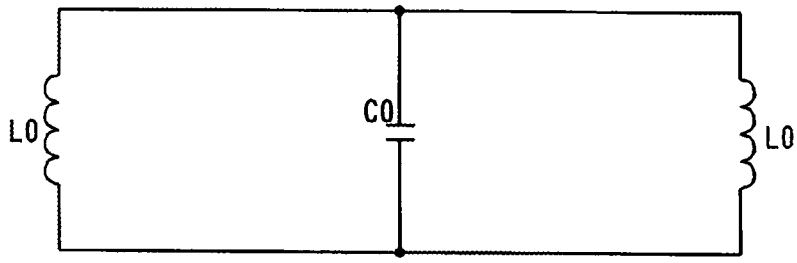

FIG. 3A is an equivalent circuit diagram of the resonator shown in FIGS. 1A and 1B. FIG. 3B is an equivalent circuit diagram of a slot resonator. The slot resonator shown in FIG. 3B includes only the conductive film 10, which has the conductor opening portions APa, APb, and APc, and does not have the conductor lines 2*a*, 2*b*, and 2*c* shown in FIG. 1A. When the inductive regions defined by the inductive opening portions APa and APb and the capacitive region defined by the capacitive opening portion APc are expressed with inductance L0 and capacitance C0, respectively, the slot resonator can be expressed as shown in FIG. 3B. Thus, the slot resonator having the openings APa, APb, and APc functions as an LC parallel resonator circuit in terms of a lumped element circuit.

The resonance units defined by the conductor lines 2*a*, 2*b*, and 2*c* shown in FIGS. 1A and 1B each have a structure in which the capacitive area and the inductive areas are interconnected to have a ring-like shape. Thus, when expressed with a parallel circuit having capacitors and inductors, the equivalent circuit of the entire resonator can be expressed as shown in FIG. 3A.

As described above, arranging the multi-step ring resonator element in the conductor opening portion, which serves as an inductive region of the slot resonator, can ease current concentration at the edge of the conductor opening portion serving as an inductive region. As a result, conductor loss can be reduced. Further, setting the width and spacing of the conductor lines of the multi-step ring resonator element to be less than or substantially equal to the skin depth of the conductor and increasing the number of conductor lines can suppress conductor loss caused by the edge effect of the entire resonator. To enhance the conductor-loss improving efficiency, however, it is important that, when viewed in a radial cross section of the multi-step ring resonator element, the ratio of the amount of electrical current flowing through the conductor lines to the amount of electrical current flowing along the edge of the conductor opening portion be set to an optimum value. This ratio of current is controlled in accordance with the ratio of the total capacitance (hereinafter referred to as a "total capacitance value") in the capacitive areas within the multi-step ring resonator element to capacitance formed in the conductor opening portion APc.

Figure 4A:
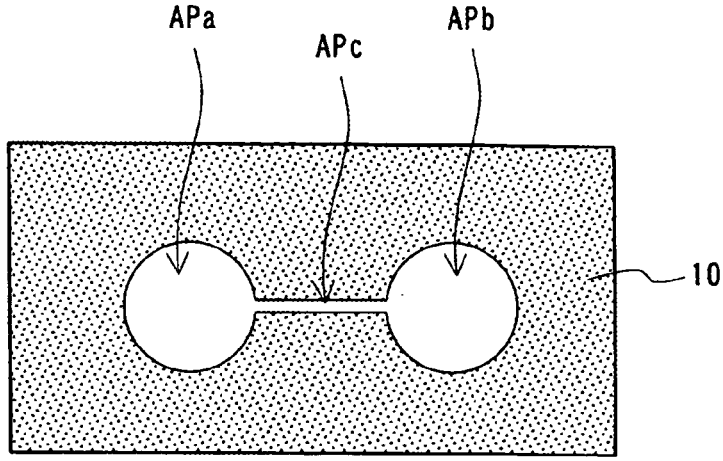
FIGS. 4A and 4B are schematic views showing a resonator model and a graph showing an improving effect of Q-factor of a conductor, the improving effect being obtained by a multi-step ring resonator element.
Figure 4B:
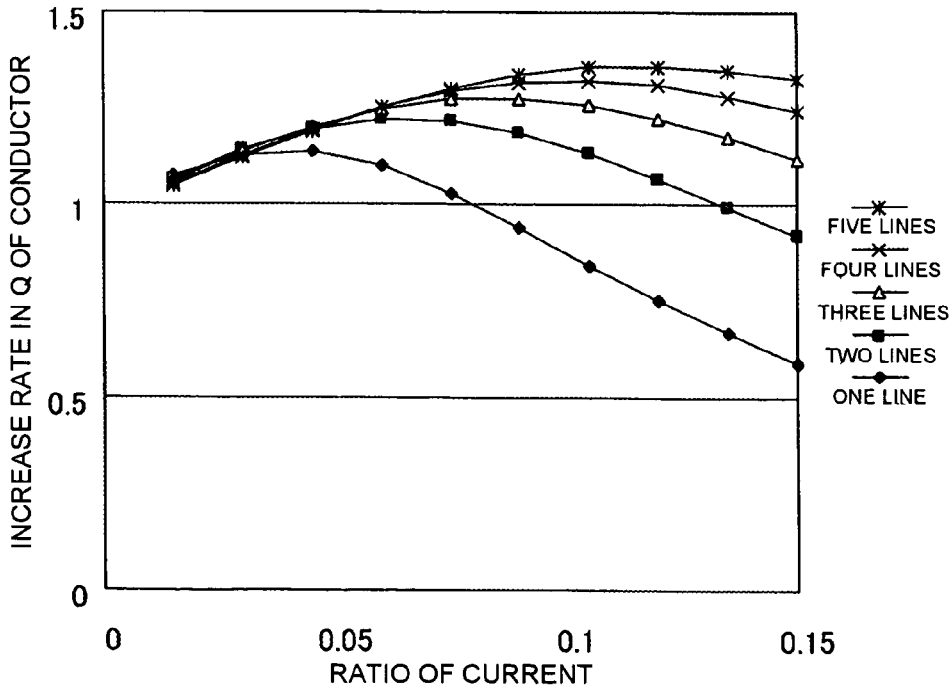

FIG. 4B shows a result obtained by simulation of the ratio of current versus the conductor loss. FIG. 4A shows a resonator model therefor. The diameter of conductor opening portions APa and APb was set to 0.7 mm and the length of the conductor opening portion APc was set to 0.7 mm. Then, the number of conductor lines of the multi-step ring resonator element provided in each of the conductor opening portions APa and APb was changed from one to five. The horizontal axis in FIG. 4B corresponds to the ratio of the total capacitance value of the multi-step ring resonator element to the capacitance of the capacitive region defined by the conductor opening portion APc. The vertical axis indicates an increase rate in Q-factor of the conductor. It can be seen that, as the Q-factor of the conductor increases, the conductor loss is suppressed. As shown in FIG. 4B, as the number of conductor lines in the multi-step ring resonator element is increased, the conductor loss can be reduced. Further, as the number of conductor lines is increased under the condition that the rate of current flowing through the multi-step ring resonator element is increased, the conductor loss reduction effect is enhanced. Based on the relationship, an optimum number of conductor lines, the total capacitance value of the multi-step ring resonator element, and the slot width of the conductor opening portion APc that functions as a capacitive region of the slot resonator may be set by considering the dimensional accuracy and the pattern-forming accuracy limit of the conductor lines of the multi-step ring resonator element.

A resonator according to a second embodiment of the present invention will now be described with reference to FIGS. 5A–5D, 6A–6C, 7A–7C and 8.

Figure 5D:
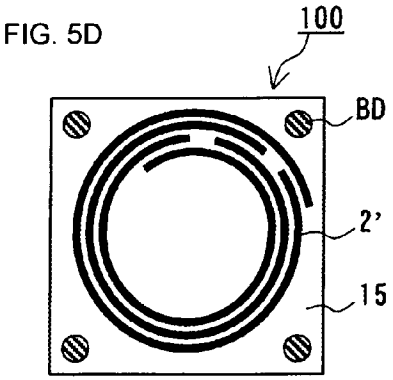
FIGS. 5A to 5D show the configuration of a resonator according to a second embodiment of the present invention.
Figure 5B:
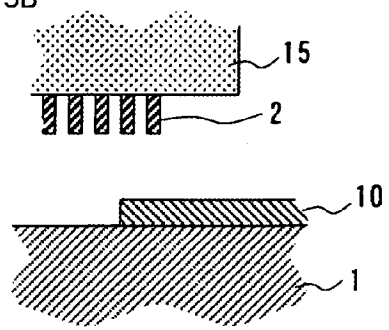
Figure 5C:
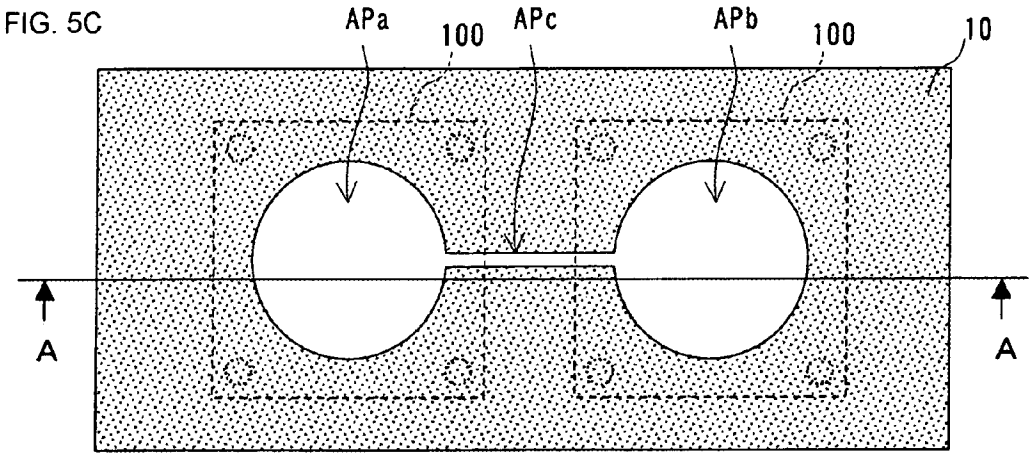
Figure 5A:
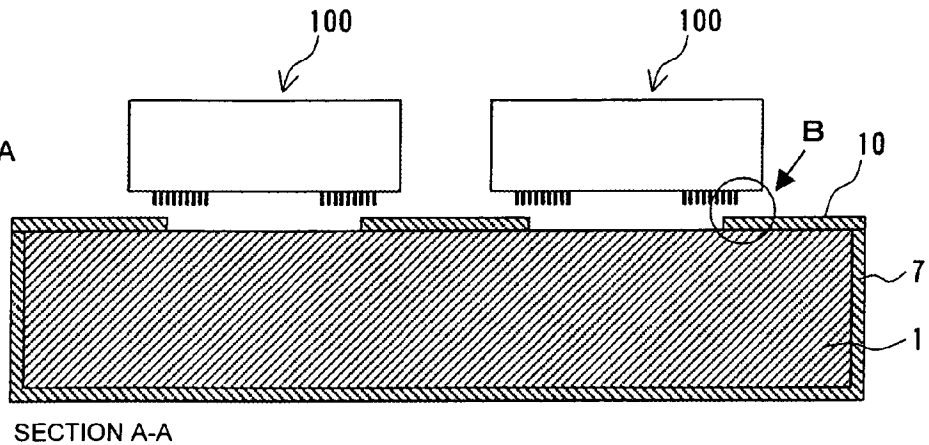

FIG. 5C is a top view of a resonator and FIG. 5A is a sectional view of the section A—A shown in FIG. 5C. FIG. 5B is an enlarged view of a portion B shown in FIG. 5A. FIG. 5D is a schematic view showing the configuration of one resonator element 100 for use in the resonator.

A conductive film 10 is provided on the top surface of a rectangular-plate dielectric substrate 1. The conductive film 10 preferably has a dumbbell-shaped conductor opening portion, which is defined by conductor opening portions APa, APb, and APc. The resonator elements 100 are mounted above the conductor opening portions APa and APb. Since FIG. 5C shows a state in which the resonator elements 100 are not mounted, positions at which the resonator elements 100 are to be mounted are indicated by dotted lines.

In each resonator element 100, a conductor-line aggregate 2' is provided on a rectangular-plate substrate 15. The individual lines of the conductor-line aggregate 2' are analogous to those provided in the conductor opening portions APa and APb illustrated in the first embodiment. Thus, each resonator element 100 functions as a multi-step ring resonator element as well. In the first embodiment, the conductor-line aggregate 2' is formed on the dielectric substrate 1, simultaneously with the conductive film 10, by thick-film printing. In the second embodiment, however, the conductor-line aggregate 2' is formed of thin films by photolithography, such as, etching or a lift-off process.

In FIG. 5D, both the width and the spacing of the conductor lines are illustrated to be extremely large, with a small number of conductor lines, for clarity of the pattern thereof. When a thin-film micro fabrication technique is used, the line width and the line spacing can be greatly reduced compared to a case using thick-film printing. As a result, the overall conductor loss can be effectively reduced.

When the resonator elements 100 are mounted on the top surface of the dielectric substrate 1, four corner-portions BD of each resonator element 100 are joined to the dielectric substrate 1. In this state, the resonator elements 100 are mounted such that the outermost one or some of the plurality of conductor lines of each resonator element 100 are positioned to partially overlap the edge of each of the conductor opening portions APa and APb.

With this arrangement, the multi-step ring resonator elements can be fabricated independently from the slot resonator. As a result, the portion having a large conductive-film area can be fabricated at low cost by thick-film printing or the like. The conductor lines of the resonator elements 100 can also be formed to be very minute by a thin-film micro fabrication technique. This arrangement, therefore, can reduce the overall size and the cost. Additionally, in the example shown in FIGS. 5A to 5D, a shield electrode 7 is provided on the four side surfaces and the bottom surface of the dielectric substrate 1. Thus, interference with other resonators and lines can be reduced and unwanted waves can be suppressed.

Further, since the resonator elements 100 are mounted such that the conductor-line aggregates 2' of the resonator elements 100 partially overlap the edges of the conductor opening portions of the dielectric substrate 1, the sensitivity of electrical characteristic variation due to horizontal displacement at the time of mounting of the resonator elements 100 can be reduced and a resonator having reduced characteristic variations can be easily manufactured.

Next, with reference to FIGS. 6A–6C, 7A–7C and 8, a description is given of an experimental result for a Q-factor improving effect obtained by mounting the resonator element 100 having the multi-step ring resonator element.

Figure 6A:
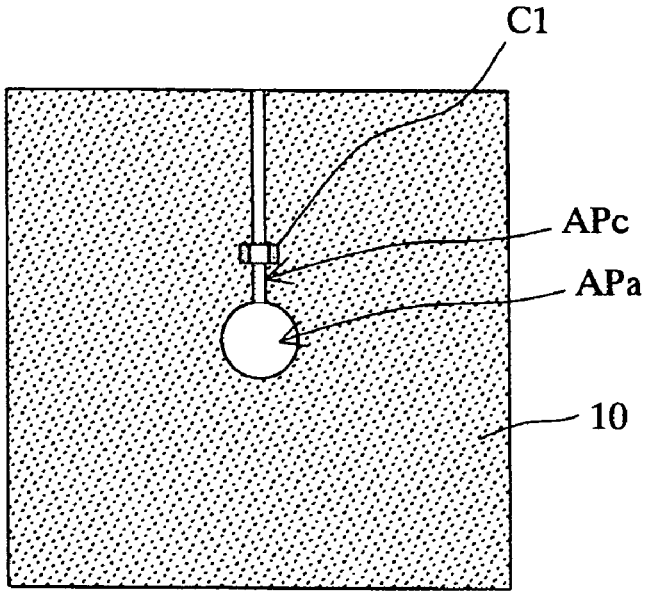
FIGS. 6A, 6B, and 6C show the configuration of a resonator for use in measurement of the Q-factor improving effect obtained by mounting a resonator element.
Figure 6B:
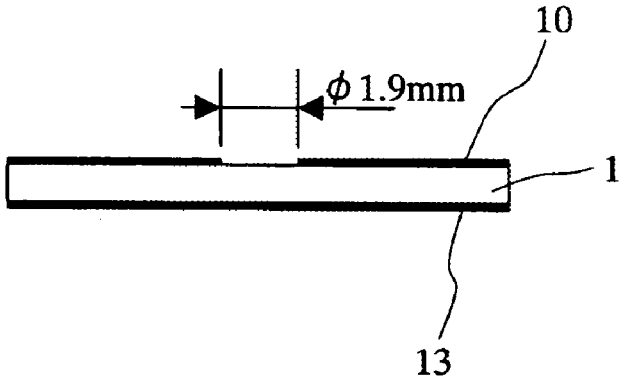
Figure 6C:
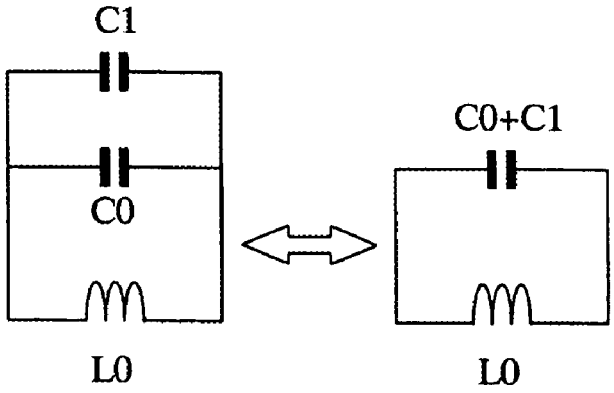

FIGS. 6A to 6C show a slot resonator model before the resonator element 100 is mounted. In this case, in order to perform the experiment with a single resonator element, the resonator is configured such that a single circular conductor opening portion APa and a slot-shaped conductor opening portion APc are provided and also a chip capacitor C1 is mounted at a predetermined position along the slot-shaped conductor opening portion APc. FIG. 6A is a top view of the resonator, FIG. 6B is a sectional view across the conductor opening portion APa thereof, and FIG. 6C is an equivalent circuit diagram of the resonator. L0 indicates inductance corresponding to an inductive region defined by the conductor opening portion APa, C0 indicates capacitance corresponding to a capacitive region defined by a conductor opening portion APc, and C1 indicates the capacitance of the chip capacitor C1.

Figure 7A:
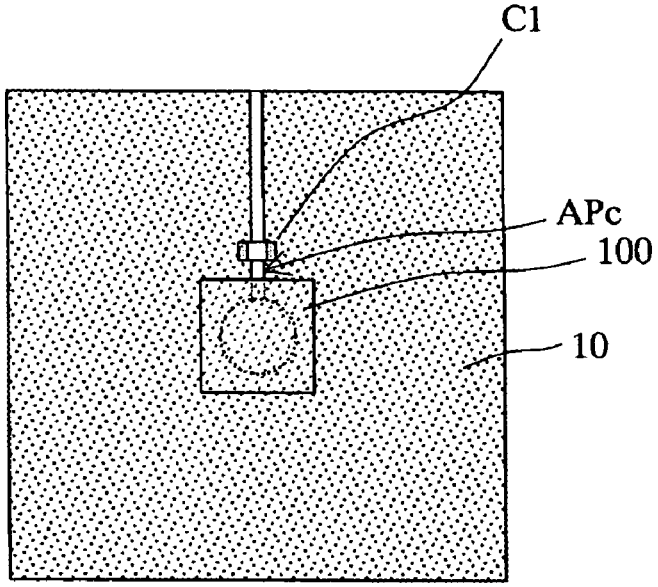
FIGS. 7A, 7B, and 7C show a structure in which the resonator element is mounted above the resonator shown in FIGS. 6A, 6B, and 6C.
Figure 7B:
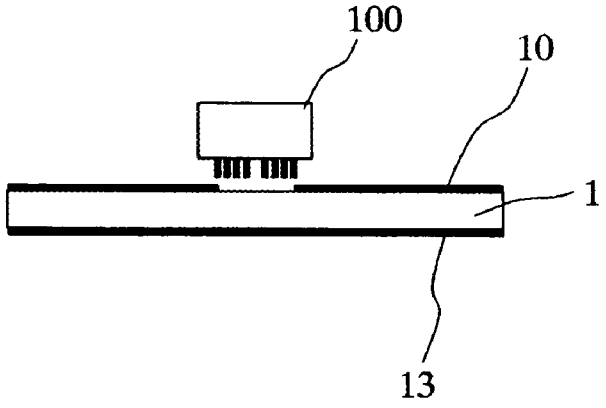
Figure 7C:
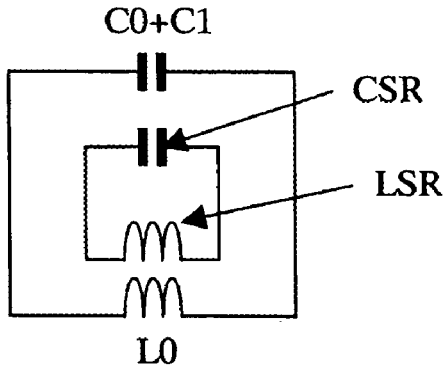

FIGS. 7A to 7C indicate a structure in which the resonator element 100 is mounted on the resonator model shown in FIGS. 6A to 6C. Part of the conductor lines of the multi-step ring resonator element provided on the resonator element 100 is inductively coupled with the inductive region defined by the conductor opening portion APa shown in FIG. 6A. Thus, the structure has the equivalent circuit as shown in FIG. 7C. In FIG. 7C, LSR indicates inductance provided by the resonator element 100 and CSR indicates capacitance provided by the resonator element 100. The multi-step ring resonator element provided on the resonator element 100 has a diameter of 1.9 mm and includes about 230 conductor lines (resonance units).

Figure 8:
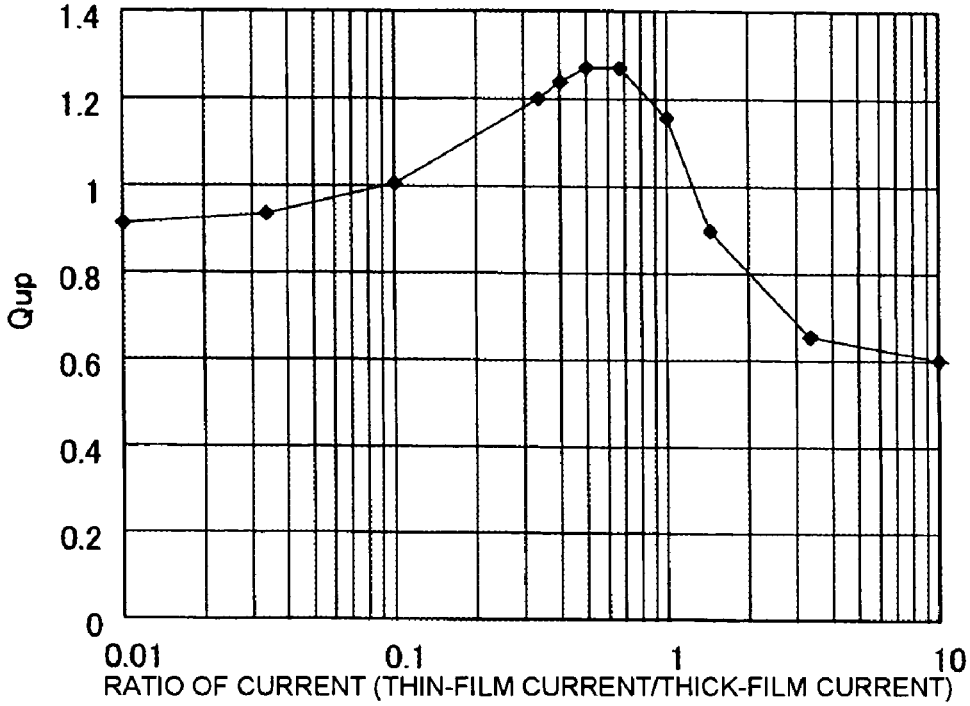
FIG. 8 is a graph showing the ratio of current versus the Q-factor improving effect of a multi-step ring resonator element relative to a slot resonator.

FIG. 8 is a graph showing the ratio of current versus the Q-factor improving effect of the multi-step ring resonator element relative to the slot resonator. The horizontal axis indicates the ratio of the amount of current flowing through the multi-step ring resonator element of the resonator element 100 to the amount of current flowing through the conductive film 10 provided on the dielectric substrate 1. The vertical axis indicates the ratio of Q-factor improvement obtained by mounting the resonator element 100. The ratio of current corresponds to the ratio of the total capacitance value of the multi-step ring resonator element provided on the resonator element 100 to the capacitance of the chip capacitor C1.

As shown, the Q-factor improving effect varies depending on the ratio of current. In order to most efficiently enhance the Q-factor, an optimum number of conductor lines, the total capacitance value of the multi-step ring resonator element, and the slot width of the conductor opening portion APc that functions as a capacitive region of the slot resonator may be set by considering the dimensional accuracy and the pattern-forming accuracy limit of the conductor lines on the multi-step ring resonator element.

Figure 9C:
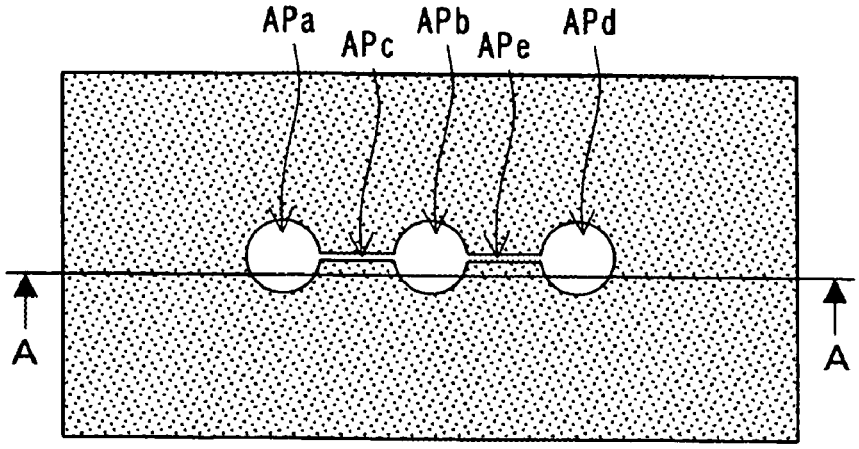
FIGS. 9A to 9C show the configuration of a resonator according to a third embodiment of the present invention.
Figure 9A:
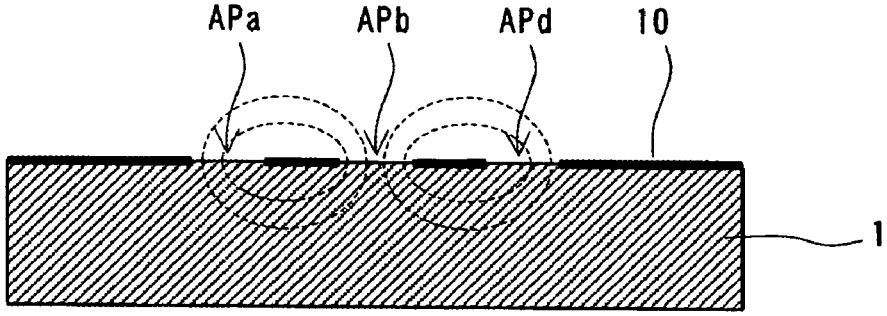
Figure 9B:
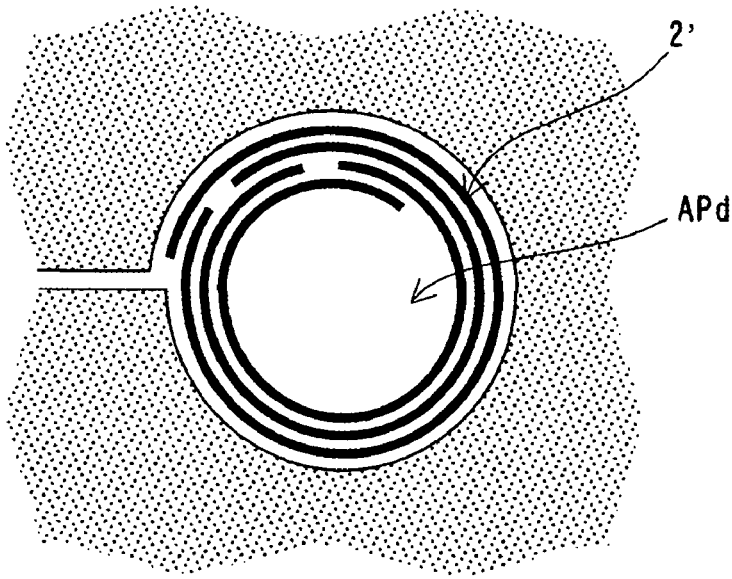

FIGS. 9A, 9B, and 9C show a resonator according to a third embodiment of the present invention. FIG. 9C is a top view of the resonator, FIG. 9A is a sectional view of the section A—A shown in FIG. 9C, and FIG. 9B is an enlarged view of a portion shown in FIG. 9C.

This resonator is an example in which three conductor opening portions, each serving as an inductive region, are provided on a dielectric substrate 1. A conductive film 10, which has conductor opening portions APa to APe as shown in FIG. 9C, is provided on the top surface of a rectangular-plate dielectric substrate 1. Of the conductor opening portions APa to APe, the openings APa, APb, and APd each serve as an inductive region and the openings APc and APe each serve as a capacitive region. Further, the conductor opening portions APa, APb, and APd, each serving as an inductive region, include multi-step ring resonator elements, respectively, as in the first embodiment. FIG. 9B shows the configuration of the multi-step ring resonator element in the conductor opening portion APd. The configuration of a conductor-line aggregate 2' is analogous to that in the first embodiment.

With this arrangement, a set of two inductive regions defined by the conductor opening portions APa and APb and one capacitive region defined by the conductor opening portion APc serves as one (first stage) resonator. Further, a set of two inductive regions defined by the conductor opening portions APb and APd and one capacitive region defined by the conductor opening portion APe serves as another (second stage) resonator. The two resonators have magnetic field distributions as indicated by dotted lines in FIG. 9A, and the magnetic fields of the two resonators couple with each other. Thus, the resonator of the third embodiment functions as a two-stage coupled resonator.

Figure 10B:
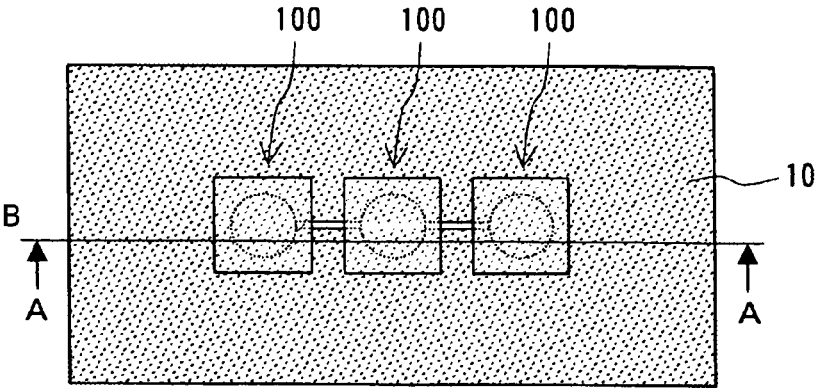
FIGS. 10A and 10B show the configuration of a resonator according to a fourth embodiment of the present invention.
Figure 10A:
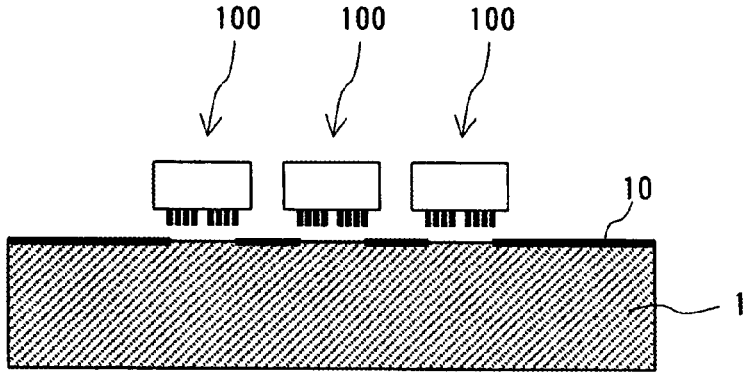

FIGS. 10A and 10B show the configuration of a resonator according to a fourth embodiment of the present invention. FIG. 10B is a top view of a resonator and FIG. 10A is a sectional view of the section A—A shown in FIG. 10B.

This resonator has a configuration in which the number of slot resonator stages illustrated in the second embodiment is two. That is, a conductive film 10, which has three conductor opening portions serving as respective inductive regions, is provided on a dielectric substrate 1, as in the one shown in FIG. 9C, and the resonator elements 100 are mounted above the conductor opening portions. This arrangement can provide a resonator that functions as a two-stage resonator when counted in the units of slot resonators.

Figure 11A:
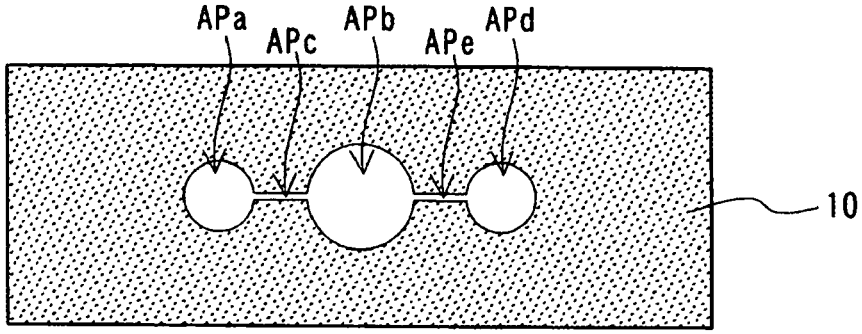
FIGS. 11A to 11C show the configurations of three types of resonators according to a fifth embodiment of the present invention.
Figure 11B:
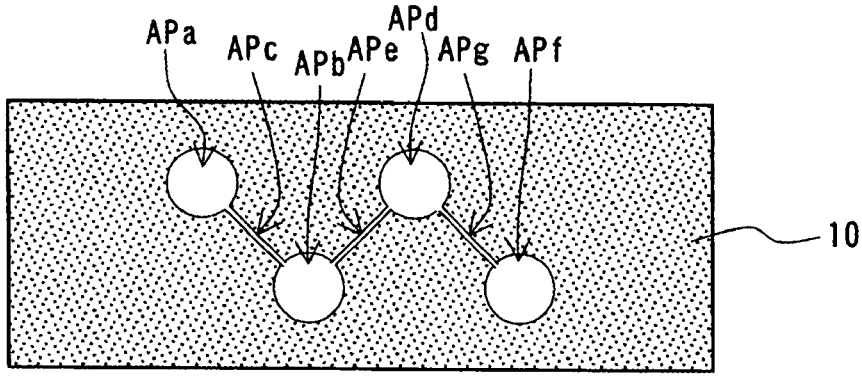
Figure 11C:
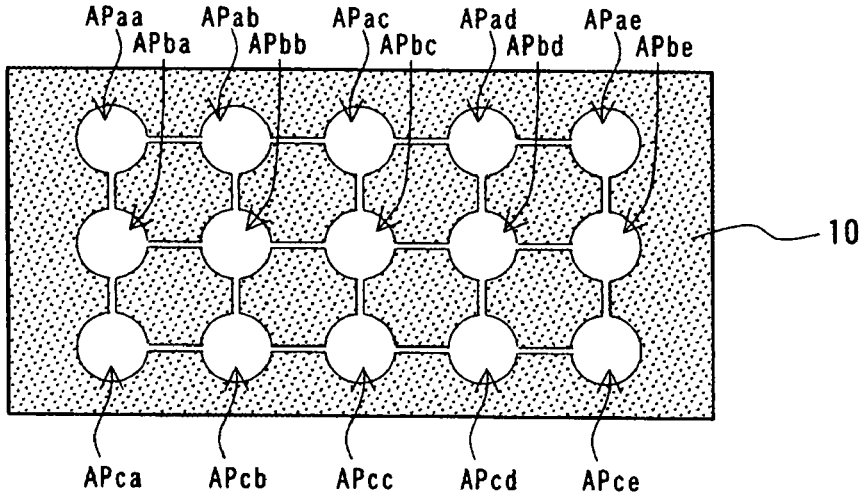

FIGS. 11A, 11B, and 11C show examples of three resonators having different patterns of conductor opening portions. All of FIGS. 11A, 11B, and 11C are top views of resonators and show only patterns of the conductive film 10 on a dielectric substrate. In these examples, the multi-step ring resonator elements or the step-ring resonator elements as illustrated in the first embodiment are provided in all or some of the conductor opening portions that respectively serve as inductive regions, or the resonator elements 100 as illustrated in the second embodiment are mounted above all or some of the conductor opening portions.

In the example of FIG. 11A, of conductor opening portions APa to APe, the conductor opening portions APa, APb, and APd having large openings serve as inductive regions and the conductor opening portions APc and APe having small openings serve as capacitive regions. The center conductor opening portion APb has a larger diameter than the conductor opening portions APa and APd. With this arrangement, a difference occurs between two-mode (even mode and odd mode) resonant frequencies that appear as a result of the coupling of two resonators. Thus, the coupling coefficient between the two resonators can be controlled. For example, when the sizes of the conductor opening portions APa and APd located at the opposite sides are fixed, the coupling coefficient can be set to a desired value by varying the size of the center conductor opening portion APb relative to those of the conductor opening portions APa and APd. Further, the conductor loss in a mode (odd mode) in which magnetic field energy is concentrated at the center conductor opening portion APb is reduced. As a result, the Q-factor of the resonator is improved.

In the example shown in FIG. 11B, the directions of adjacent resonators, each constituted by two inductive regions and one capacitive region, are made different from each other. In this case, each of the conductor opening portions APa, APb, APd, and APf serves as an inductive region and each of the conductor opening portions APc, APe, and APg serves as a capacitive region. In this manner, resonators, each defined by a set of two inductive regions and one capacitive region, are sequentially connected together by sharing one inductive region, thereby allowing for the configuration of a multi-stage slot resonator. Further, a large number of inductive regions can be arranged within a limited area, which is advantageous in providing a multi-stage resonator.

In addition, the directions of magnetic field loops of the adjacent resonators are different from each other. Thus, the directions (the crossing angles) can be changed to set the coupling strength between the adjacent resonators.

In the example shown in FIG. 11C, conductor opening portions APaa to APce are arranged in a matrix with 5 columns and 3 rows so as to serve as inductive regions, and conductor opening portions, which interconnect the corresponding conductor opening portions APaa to APce in a lattice manner, are arranged so as to serve as capacitive regions. Since the number of capacitive regions is equal to the number of resonators, the structure in this example functions as a 22-stage resonator.

Figure 12C:
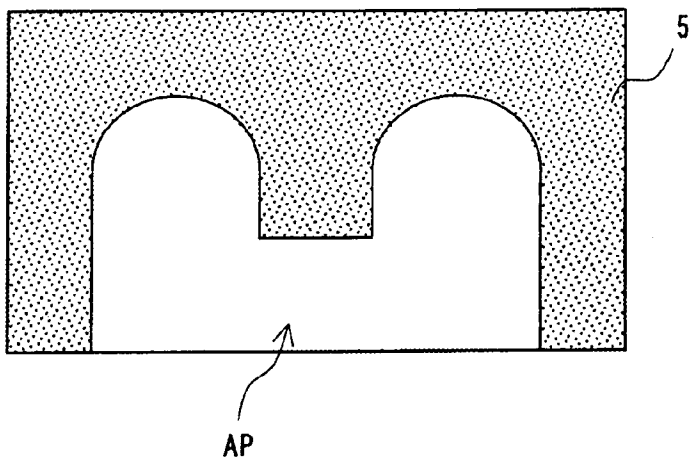
FIGS. 12A and 12D show the configuration of a resonator according to a sixth embodiment of the present invention.
Figure 12D:
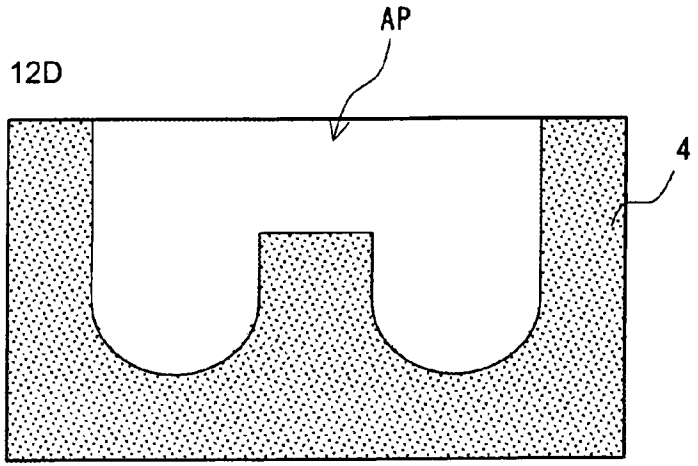
Figure 12B:
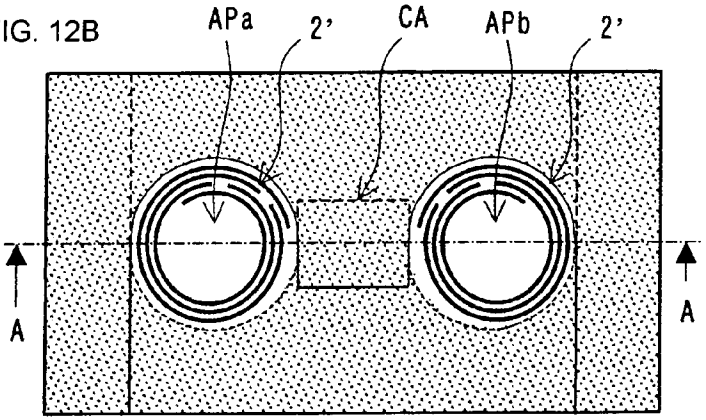
Figure 12A:
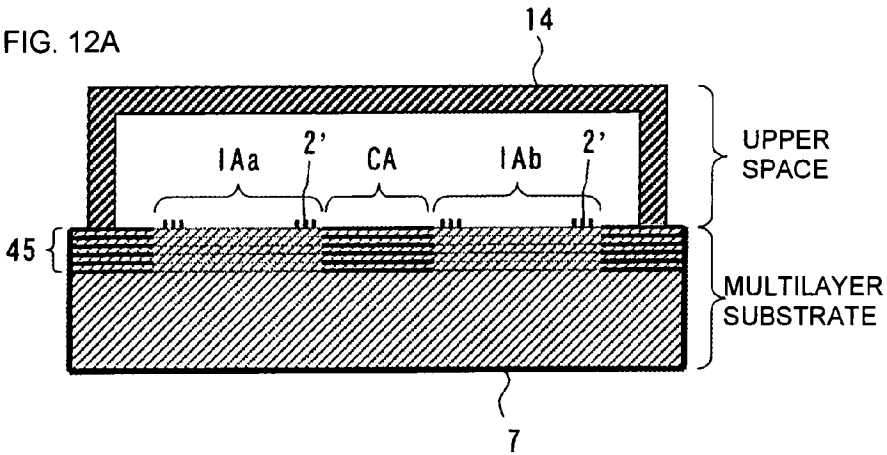

FIGS. 12A to 12D show the configuration of a resonator according to a sixth embodiment of the present invention. FIG. 12B is a top view of a resonator from which an upper shield cap 14 is removed and FIG. 12A is a sectional view of the section A—A shown in FIG. 12B. FIGS. 12C and 12D show preferred patterns of the conductive layers.

As shown in FIG. 12A, a stacked portion 45, in which conductive layers and dielectric layers are alternately stacked, is provided in the multilayer substrate 12. As shown in FIGS. 12C and 12D, the stacked portion 45 is configured such that conductive layers 4 and 5, which have two types of patterns, are alternatively stacked with corresponding dielectric layers interposed therebetween. The conductive layers 4 and 5 are electrically connected to a shield electrode 7 that is provided on the four side surfaces and the bottom surface of the multilayer substrate 12. Thus, regions in which either of the conductive layers 4 and 5 is not provided in the stacking direction of the dielectric layers and the conductive layers serve as inductive regions IAa and IAb. A region in which the conductive layers 4 and 5 face each other with the corresponding dielectric layers interposed therebetween serves as a capacitive region CA.

Further, conductor-line aggregates 2', each functioning as a multi-step ring resonator element, are provided in conductor opening portions APa and APb corresponding to the inductive regions IAa and IAb.

As described above, the conductive layers and the dielectric layers are stacked to constitute the capacitive region CA. This makes it possible to reduce the size of the capacitive region, thereby providing a more miniaturized resonator.

In addition, attaching the conductive shield cap 14 to the upper portion of the multilayer substrate 12 can provide a resonator having a shielding structure.

The multilayer substrate 12 can be manufactured by a manufacturing method for a laminated multilayer substrate, including a series of processes, such as forming sheet patterns by printing conductive paste on dielectric ceramic green sheets and stacking, pressing, and firing the sheets. A manufacturing method, including sequentially printing dielectric layers and conductive layers on a substrate and firing the resulting structure, can also be used.

An exemplary configuration of a filter according to a seventh embodiment of the present invention will now be described with reference to FIGS. 13A to 13E.

Figures 13A, 13B, 13C, 13D, 13E:
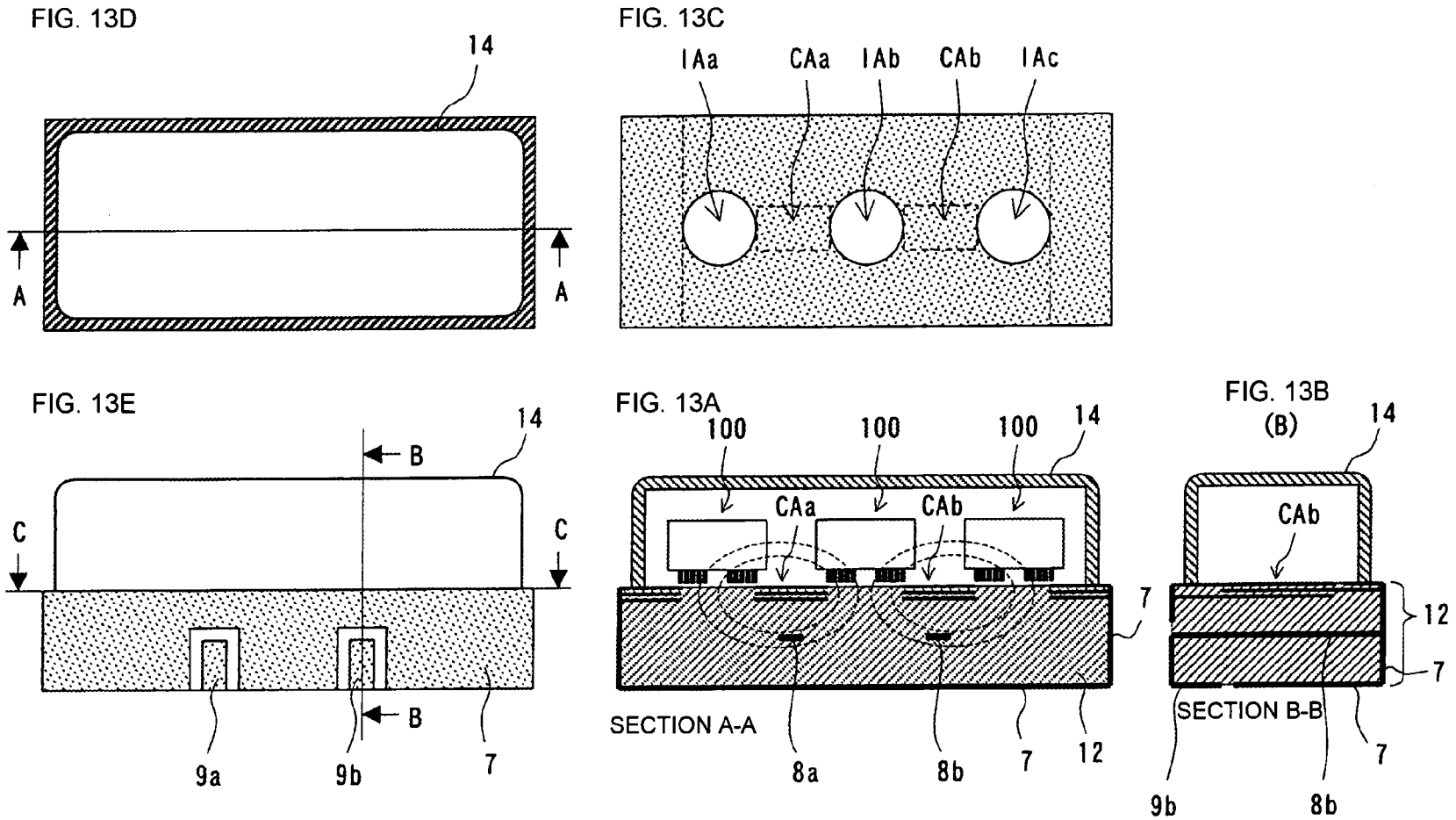
FIGS. 13A to 13E show the configuration of a filter according to a seventh embodiment of the present invention.

FIG. 13D is a top view of a filter and FIG. 13A is a sectional view of the section A—A shown in FIG. 13D. FIG. 13E is a front view of the filter and FIG. 13B is a sectional view of the section B—B shown in FIG. 13E. FIG. 13C is a top view (a plan view of the section C—C shown in FIG. 13E) of the filter from which an upper shield cap 14 is removed. In a multilayer substrate 12, a plurality of conductive layers, which have two types of patters, are alternately stacked with corresponding dielectric layers interposed therebetween, in the same manner as the structure of the multilayer substrate 12 shown in FIG. 12A. With this structure, three inductive regions IAa, IAb, and IAc and two capacitive regions CAa and CAb, which interconnect the corresponding inductive regions IAa, IAb, and IAc, are provided.

As shown in FIGS. 13A and 13B, in the multilayer substrate 12, input/output coupling electrodes 8*a* and 8*b* are provided at positions away from portions where the two patterns of conductive layers are stacked. One end of each of the input/output coupling electrodes 8*a* and 8*b* is electrically connected to a shield electrode 7 provided on the side surfaces of the multilayer substrate 12 and the other ends of the input/output coupling electrode 8*a* and 8*b* are electrically connected to the corresponding input/output terminals 9*a* and 9*b*. With this structure, the input/output coupling electrodes 8*a* and 8*b* and the shield electrode 7 define a coupling loop.

A set of two inductive regions IAa and IAb and one capacitive region CAa serves as one (first-stage) resonator and a set of two inductive regions IAb and IAc and one capacitive region CAb serves as another (second-stage) resonator. The two resonators have magnetic field distributions as indicated by the dotted lines shown in FIG. 13A, and the magnetic fields of the input/output coupling electrodes 8*a* and 8*b* couple with those of the corresponding resonators. Thus, this filter functions as a filter that displays band-pass characteristics of a two-stage resonator.

In this manner, the filter can be used as a filter having miniaturized resonators with a high unloaded Q-factor Qo and having a low insertion-loss bandpass characteristic.

In FIGS. 9A, 9C, 10A, 10B, 11B, 11C, 13A and 13C, the sizes of the adjacent conductor opening portions have been illustrated as being the same. However, when a plurality of resonators, each defined by a set of two inductive regions and one capacitive region, as shown in those figures, is used, the sizes of the conductor opening portions may be made different from each other in order to set the coupling coefficient between the adjacent resonators. As described above, changing the sizes of adjacent conductor opening portions produces a difference between the even-mode frequency and the odd-mode frequency of two resonators, so that the coupling coefficient between the two resonators can be controlled. Similarly, changing the shapes of the conductor opening portions allows the coupling coefficient between two resonators to be controlled.

A resonator according to an eighth embodiment of the present invention will now be described with reference to FIGS. 14A and 14B.

In the example shown in FIGS. 1A and 1B, in the step-ring resonator element provided in the conductor opening portion that serves as an inductive region on the dielectric substrate 1, the ring-like resonance unit is configured using the single conductor line 2 with one end thereof being located adjacent to the other end thereof. However, the number of conductor lines constituting the resonance unit does not necessarily have to be one and thus may be two or more. That is, the arrangement may be such that one resonance unit is constituted by a plurality of conductor lines and one end of the conductor line 2 is placed adjacent to one end of another conductor line included in the same resonance unit. With this arrangement, therefore, one resonance unit has a plurality of capacitive areas and a plurality of inductive areas. For example, as shown in FIG. 14A, one ring-like resonance unit may be constituted by two conductor lines. In the example shown in FIG. 14A, two conductor lines 2*a* and 2*b* are each arranged on a surface of a dielectric substrate 1 so as to extend halfway or more around a circle circumference. Similarly, conductor lines may be each arranged to define an angle range that exceeds one third of a circle circumference so that three capacitive areas are provided in one circle.

Figure 14A:
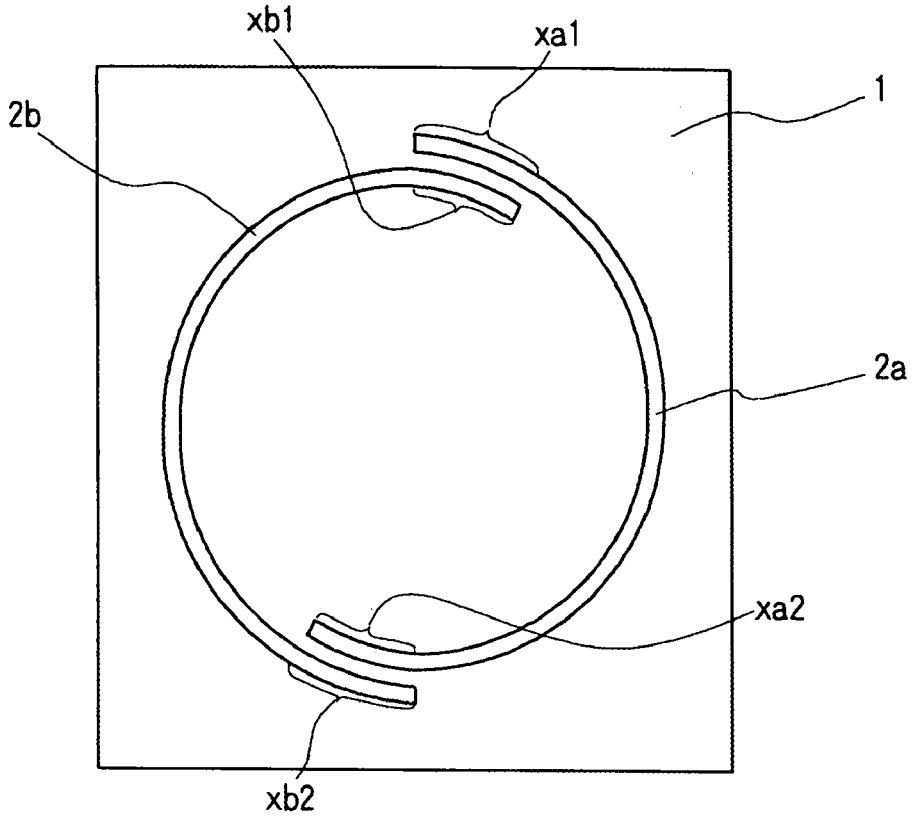
FIGS. 14A and 14B show configurations of a major portion of a resonator according to an eighth embodiment of the present invention.

In the example of FIG. 14A, a first end xal of the conductor line 2*a* and a first end xb1 of the conductor line 2*b* are placed adjacent to each other in the width direction. In addition, a second end xa2 of the conductor line 2*a* and a second end xb2 of the conductor line 2*b* are placed adjacent to each other in the width direction. As a result, in the regions where the two pairs of adjacent ends are located, two capacitive areas are provided. Thus, each of the conductor lines 2*a* and 2*b* serves as a half-wavelength line having the opposite ends being open.

Figure 14B:
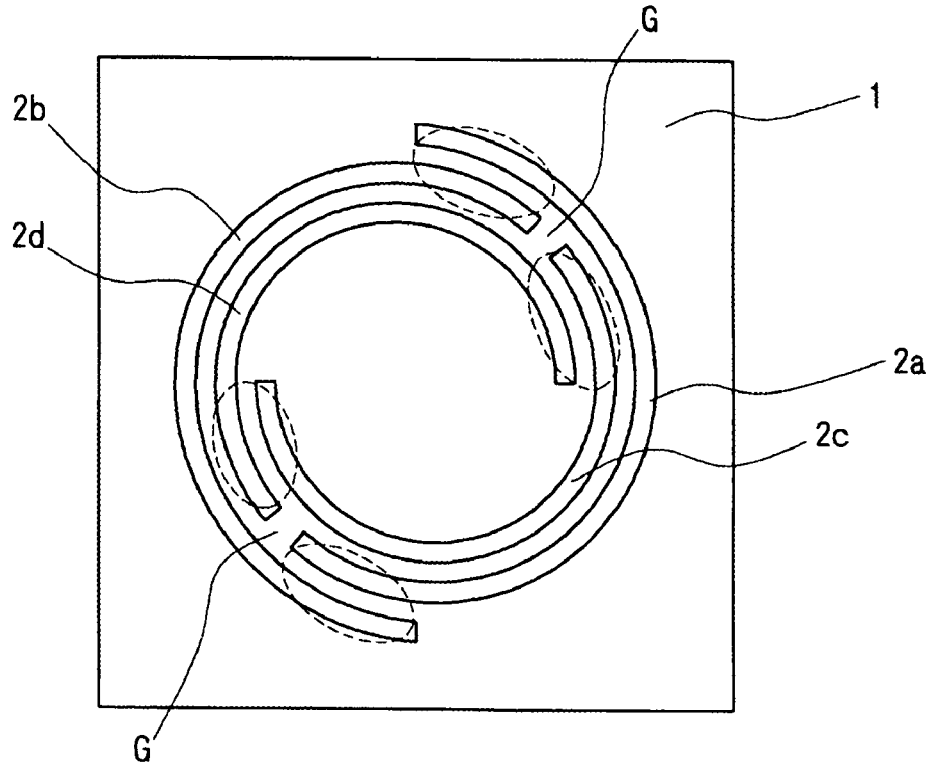

FIG. 14B shows an exemplary configuration of a resonator having two resonance units, i.e., first and second resonance units, shown in FIG. 14A. A first end of a conductor line 2*a* is adjacent to a first end of a conductor line 2*b* in the width direction and a second end of the conductor line 2*a* is adjacent to a second end of the conductor line 2*b*, so as to define two capacitive areas. Further, a first end of a conductor line 2*c* is adjacent to a first end of a conductor line 2*d* in the width direction and a second end of the conductor line 2*c* is adjacent to a second end of the conductor line 2*d*, so as to define two capacitive areas. Thus, capacitive areas are provided at four portions surrounded by dotted-line ovals shown in FIG. 14B. Further, at positions indicated by G, one edge of the conductor line 2*a*, which is included in the first resonance unit, and one edge of the conductor line 2*d*, which is included in the adjacent second resonance unit, oppose each other with a predetermined distance therebetween, and one edge of the conductor line 2*b*, which is included the first resonance unit, and one edge of the conductor line 2*c*, which is included in the adjacent second resonance unit, oppose each other with a predetermined distance therebetween. In this arrangement, the spacing between the adjacent conductor lines is fixed at positions where the resonance units are adjacent to each other. Consequently, electrical current concentration due to the edge effect can be eased along the entire conductor lines, and the conductor loss can be reduced correspondingly.

The multi-step ring resonator element in which one resonance unit is constituted by a plurality of conductor lines may also be applied to the resonator element 100 shown in FIGS. 5A to 5D.

Figure 17C:
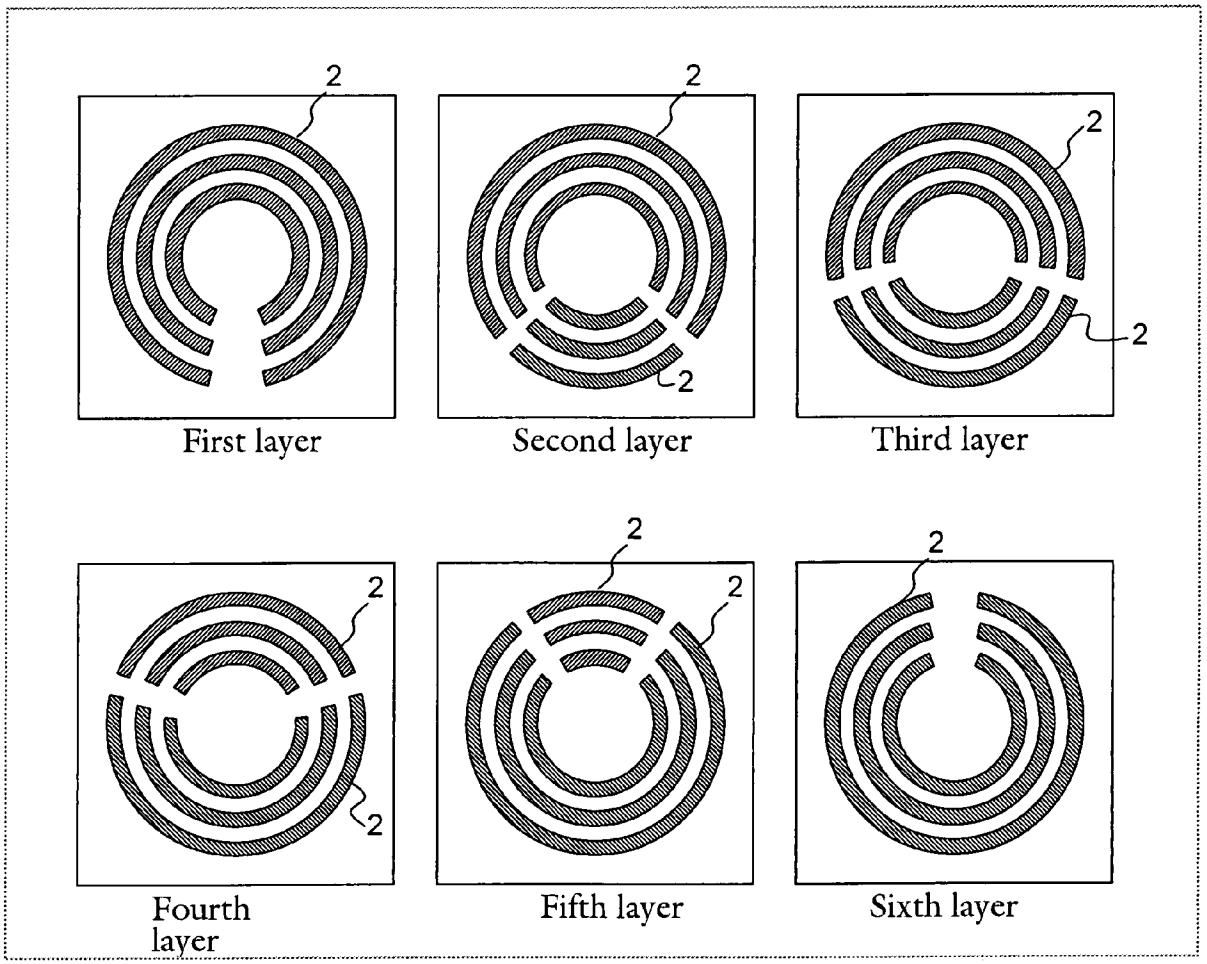
FIG. 17C shows the different layers of the resonator unit of FIG. 17A.
Figure 17A:
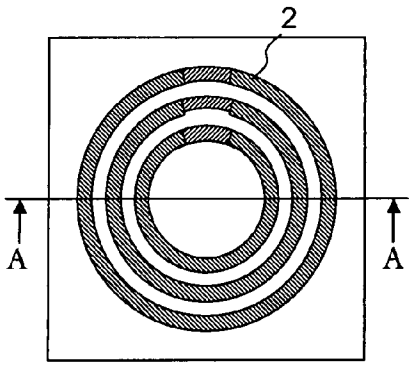
FIG. 17A is a top view of a resonator unit wherein the conductor lines of the step ring resonator element are placed adjacent to each other in the thickness direction.
Figure 17B:
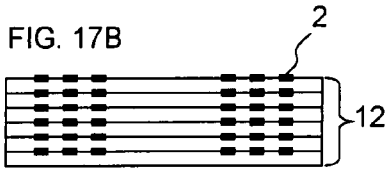
FIG. 17B is a cross section of the resonator unit along line A—A of FIG. 17A.

In the embodiments described above, although the corresponding ends of one or more conductor lines 2 constituting a step ring resonator element are placed adjacent to each other in the line-width direction, they may be placed adjacent to each other in the thickness direction with a dielectric layer interposed therebetween as shown in FIGS. 17A–17C.

FIG. 17A is a top view of a resonator unit wherein the conductor lines 2 of the step ring resonator element are placed adjacent to each other in the thickness direction. FIG. 17B is a cross section of the resonator unit along line A—A of FIG. 17A, and FIG. 17C shows six different layers of the resonator unit. Although six layers are shown in FIG. 17C, a different number of layers can also be used.

As shown in FIG. 17B, conductive layers and dielectric layers are alternately stacked to form the multilayer substrate 12. As shown in FIGS. 17B and 17C, the multilayer substrate 12 is configured such that the first through sixth conductive layers, which have differing patterns, are alternatively stacked with corresponding dielectric layers interposed therebetween. The conductive layers can be electrically connected to a shield electrode provided on the four side surfaces and the bottom surface of the multilayer substrate 12. Thus, regions in which the conductive layers are not provided in the stacking direction of the dielectric layers and the conductive layers serve as inductive regions. Regions in which the conductive layers face each other with the corresponding dielectric layers interposed therebetween serves as a capacitive regions.

As described above, the conductive layers and the dielectric layers are stacked to constitute the capacitive region. This makes it possible to reduce the size of the capacitive region, thereby providing a more miniaturized resonator.

In addition, attaching a conductive shield cap to the upper portion of the multilayer substrate 12 can provide a resonator having a shielding structure.

The multilayer substrate 12 can be manufactured by a manufacturing method for a laminated multilayer substrate, including a series of processes, such as forming sheet patterns by printing conductive paste on dielectric ceramic green sheets and stacking, pressing, and firing the sheets. A manufacturing method, including sequentially printing dielectric layers and conductive layers on a substrate and firing the resulting structure, can also be used.

Next, the configurations of a duplexer and a communication apparatus according to a ninth embodiment will be described.

Figure 15A:
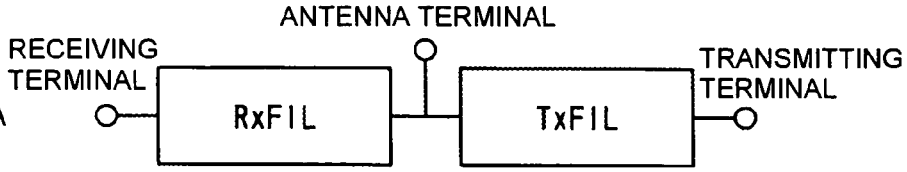
FIGS. 15A and 15B are block diagrams of a duplexer and a communication apparatus, respectively, according to a ninth embodiment of the present invention.

FIG. 15A is a block diagram of a duplexer. A transmitting filter TxFIL and a receiving filter RxFIL each preferably have the configuration shown in FIGS. 13A to 13E. The transmitting filter TxFIL and the receiving filter RxFIL are designed in accordance with respective passbands. When the duplexer is connected to an antenna terminal that serves as a transmitting/receiving terminal, phase adjustment is performed so as to prevent a transmission signal from interfering with the receiving filter RxFIL and a reception signal from interfering with the transmitting filter TxFIL.

Figure 15B:
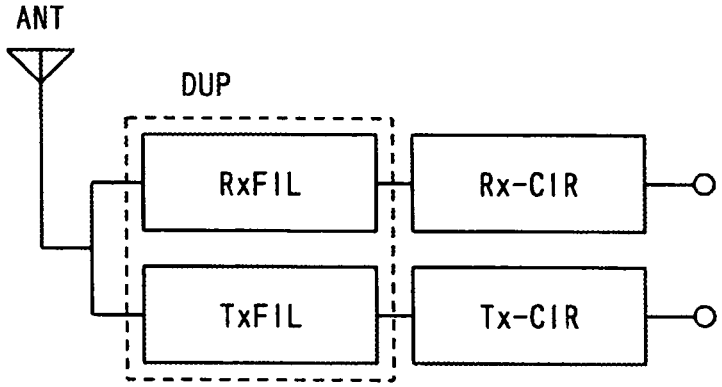
Figure 16A:
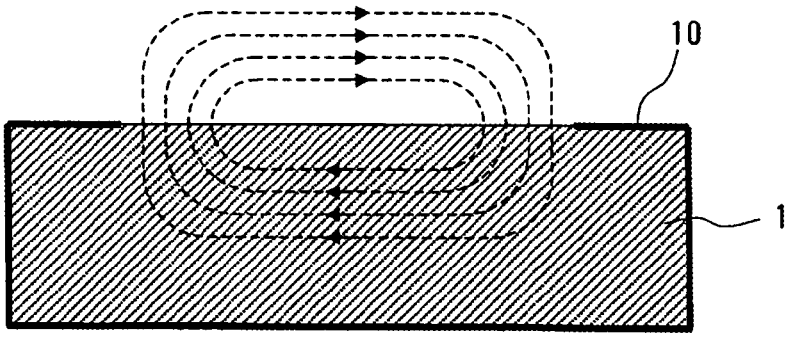
FIG. 16A PRIOR ART
FIGS. 16A and 16B show the configuration of a known resonator.
Figure 16B:
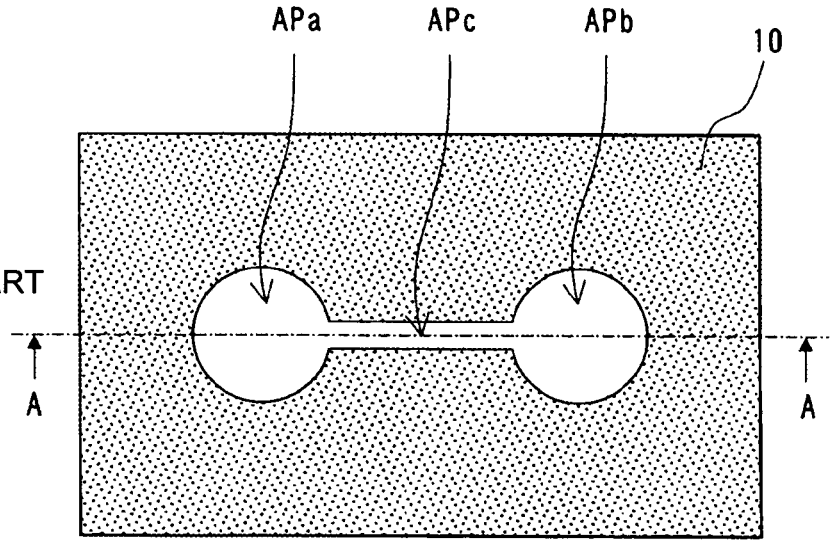
FIG. 16B PRIOR ART

FIG. 15B is a block diagram of the configuration of a communication apparatus. In this case, a duplexer DUP has the configuration shown in FIG. 15A. A transmitting circuit Tx-CIR and a receiving circuit Rx-CIR are provided on a circuit board. The duplexer DUP is also mounted on the circuit board. The transmitting circuit Tx-CIR is connected to a transmission-signal input terminal of the duplexer DUP and the receiving circuit Rx-CIR is connected to a reception-signal output terminal of the duplexer DUP. An antenna terminal is connected to an antenna ANT.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A resonator comprising:

a substrate having a surface;

a conductive film provided on the surface of the substrate, the conductive film having conductor opening portions at predetermined positions, the conductor opening portions including at least two inductive regions and at least one capacitive region, the at least one capacitive region interconnecting the inductive regions; and at least one resonator element provided for each of the at least two inductive regions, each resonator element including at least one ring-like resonance unit, each resonance unit being defined by at least one conductor line having at least one capacitive area and at least one inductive area, wherein a first end of one conductor line is placed adjacent to one of a second end of the conductor line and a first end of another conductor line included in the same resonance unit in one of a width direction and a thickness direction to define the at least one capacitive area of each resonator element.

2. The resonator according to claim 1, wherein the at least one resonator element is provided in each of the at least two inductive regions.

3. The resonator according to claim 1, wherein the at least one resonator element is provided in the vicinity of each of the at least two inductive regions.

4. The resonator according to claim 3, wherein the at least one resonator element is provided in the vicinity of each of the at least two inductive regions such that at least an outermost one of the at least one conductor line partially overlaps an edge of the conductor opening portions defining the at least two inductive regions.

5. The resonator according to claim 1, wherein the opening portion of the capacitive region is smaller than the opening portion of the at least two inductive regions.

6. The resonator according to claim 1, wherein a first and a second of the at least two inductive regions are different in size.

7. The resonator according to claim 1, wherein a plurality of sets of conductor opening portions are provided in the conductive film, each set of conductor opening portions including at least two inductive regions and at least one capacitive region, the at least one capacitive region interconnecting the at least two inductive regions, and wherein the plurality of sets of conductor opening portions are connected together by sharing at least one inductive region of the at least two inductive regions in each set of conductor opening portions.

8. The resonator according to claim 7, wherein the plurality of sets of conductor opening portions are arranged in a matrix.

9. A filter comprising:

the resonator according to claim 1; and signal input/output electrodes coupled with the resonator.

10. A communication apparatus comprising the resonator according to claim 1.

11. A communication apparatus comprising the filter according to claim 9.

* * * * *